US007000550B1

(12) United States Patent
Mandall

(10) Patent No.: US 7,000,550 B1
(45) Date of Patent: Feb. 21, 2006

(54) ABLATIVE BLAST RESISTANT SECURITY DOOR PANEL

(76) Inventor: Michael C. Mandall, Mandall Armor Design & Mfg., 901 E. Madison St., Phoenix, AZ (US) 85034

( * ) Notice: Subject to any disclaimer, the term of this patent is extended or adjusted under 35 U.S.C. 154(b) by 0 days.

(21) Appl. No.: 10/927,563

(22) Filed: Aug. 26, 2004

Related U.S. Application Data

(60) Provisional application No. 60/567,573, filed on May 3, 2004.

(51) Int. Cl.
*E06B 9/00* (2006.01)

(52) U.S. Cl. ..... 109/49.5; 109/65; 109/82; 109/78; 109/26; 109/1 S

(58) Field of Classification Search ..... 109/49.5, 109/59 R, 64, 65, 76, 78–85, 15, 26
See application file for complete search history.

(56) References Cited

U.S. PATENT DOCUMENTS

| | | | | | |
|---|---|---|---|---|---|
| 139,414 | A * | 5/1873 | Mulford | 109/82 |
| 960,767 | A * | 6/1910 | Allen | 109/82 |
| 1,232,330 | A * | 7/1917 | Kenyon | 109/27 |
| 1,623,155 | A * | 4/1927 | Bellamore | 109/65 |
| 1,625,061 | A * | 4/1927 | Trout | 428/593 |
| 1,805,610 | A * | 5/1931 | Young | 109/29 |
| 2,077,729 | A * | 4/1937 | Wilcox | 114/12 |
| 2,181,466 | A * | 11/1939 | Shackett | 52/660 |
| 2,552,515 | A * | 5/1951 | Bremer | 109/77 |
| 2,773,459 | A * | 12/1956 | Sechy | 109/82 |
| 3,969,563 | A * | 7/1976 | Hollis, Sr. | 428/175 |
| 4,178,859 | A | 12/1979 | Seiz et al. | 109/27 |
| 4,179,979 | A * | 12/1979 | Cook et al. | 89/36.02 |
| 4,727,789 | A * | 3/1988 | Katsanis et al. | 86/50 |
| 4,732,803 | A * | 3/1988 | Smith, Jr. | 428/212 |
| 4,835,033 | A * | 5/1989 | Auyer et al. | 428/131 |
| 5,060,582 | A | 10/1991 | Salzer | 109/49 |
| 5,149,910 | A * | 9/1992 | McKee | 89/36.02 |
| 5,329,864 | A * | 7/1994 | Doring | 109/49.5 |
| 5,531,500 | A * | 7/1996 | Podvin | 296/152 |
| 5,563,364 | A * | 10/1996 | Alhamad | 102/303 |
| 5,591,933 | A * | 1/1997 | Li et al. | 89/36.02 |
| 5,654,518 | A * | 8/1997 | Dobbs | 89/36.02 |
| 5,660,021 | A * | 8/1997 | Wolgamot et al. | 52/783.12 |
| 5,740,635 | A * | 4/1998 | Gil et al. | 52/79.1 |
| 5,853,863 | A * | 12/1998 | Kim | 428/223 |
| 6,240,858 | B1 | 6/2001 | Mandall | 109/49.5 |
| 6,564,850 | B1 * | 5/2003 | Chen | 160/231.1 |
| 6,736,473 | B1 * | 5/2004 | Cleveland et al. | 312/409 |

* cited by examiner

*Primary Examiner*—Suzanne Dino Barrett
(74) *Attorney, Agent, or Firm*—Cahill, von Hellens & Glazer P.L.C.

(57) ABSTRACT

Penetration resistant door panel comprises a plurality of spars having a series of holes therethrough and sandwiched between an outer skin and a rear skin. Preferably there are two series of holes in each spar that are staggered with respect to each other. The holes permit outer edges of the spars to be ablated by an explosion blast while dissipating energy to preserve the integrity of rear regions of the spars.

21 Claims, 2 Drawing Sheets

ABLATIVE BLAST RESISTANT SECURITY DOOR PANEL

CROSS REFERENCE TO RELATED APPLICATION

This application claims the benefit of prior filed co-pending U.S. provisional application Ser. No. 60/567,573 filed May 3, 2004 entitled "ABLATIVE BLAST RESISTANT SECURITY DOOR DESIGN" by Michael C. Mandall.

TECHNICAL FIELD

This invention is concerned with preventing unauthorized entry into secure areas.

BACKGROUND ART

Inventors have long been concerned with devising penetration resistant panels to serve as doors for safes and vaults.

A more-or-less conventional approach to penetration resist is to pack the interior of the panel with layers of tough materials, such as, metal screen, ceramic, gypsum and mineral fibers. This is the approach advocated by U.S. Pat. No. 5,060,582 granted Oct. 29, 1991 to H. Salzer for "High Security Blast Resistant Door Leaf".

U.S. Pat. No. 4,178,859 granted Dec. 18, 1979 to R. Seiz et al. For "Door-Like Closure" proposed a door structure possessing a multi-layer front plate backed up by a metal grid providing an array of apertures to permit pressure shock from an explosive assault on the door to pass through the structure with minimal damage to the structure.

A different approach was suggested in U.S. Pat. No. 6,240,858 granted Jun. 5, 2001 to M. C. Mandall for "Penetration Resistant Panel". In this patent the panel contains a plurality of elongated members in a serpentine configuration under axial compression. The members are adapted to straighten to extend into an opening cut or blasted through the panel and the members.

While these prior art approaches to penetration resistance are somewhat effective, there continues to be a need for an improved penetration resistance panel which is relatively easy to manufacture and is particularly effective in resisting not just one, but repeated explosive attacks.

SUMMARY OF THE INVENTION

The panel of this invention principally comprises a plurality of spars with a series of holes throughout their length and sandwiched between an outer skin and a rear skin. In a more preferred embodiment of the invention there are two rows of holes in each spar and the holes in one row are staggered with respect to the holes in the other row.

BRIEF DESCRIPTION OF THE DRAWINGS

The invention is described in greater detail hereafter by reference to the accompanying drawings wherein.

BEST MODES FOR CARRYING OUT THE INVENTION

Figure 1:
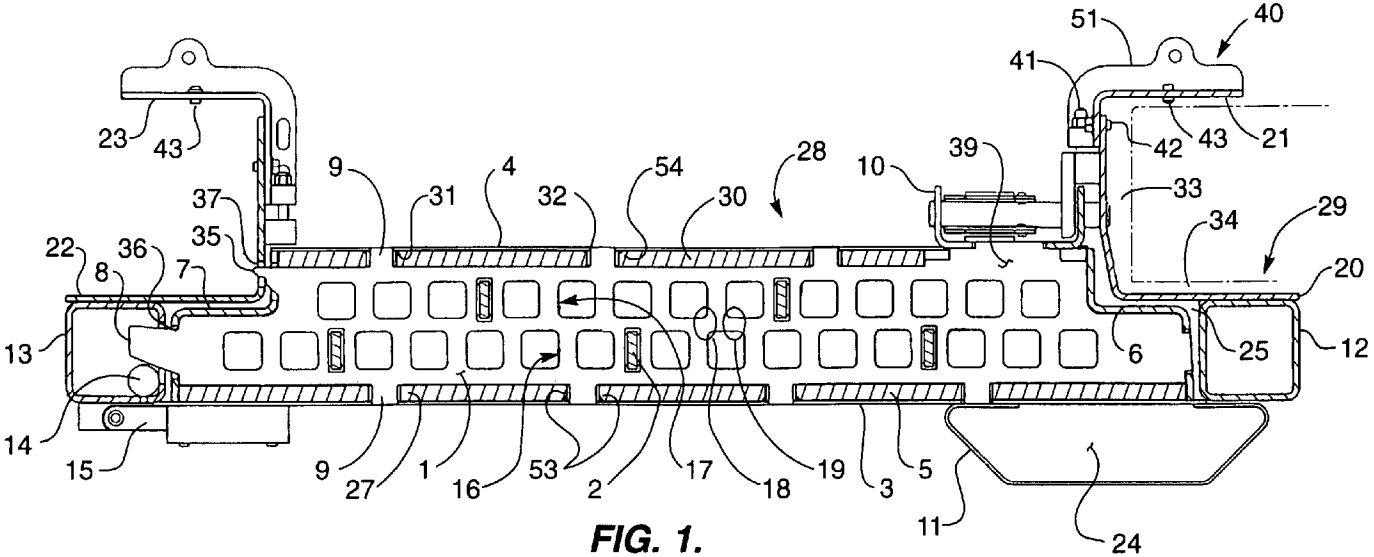
FIG. 1 is a horizontal sectional view through a door embodying the door panel of this invention.
Figure 2:
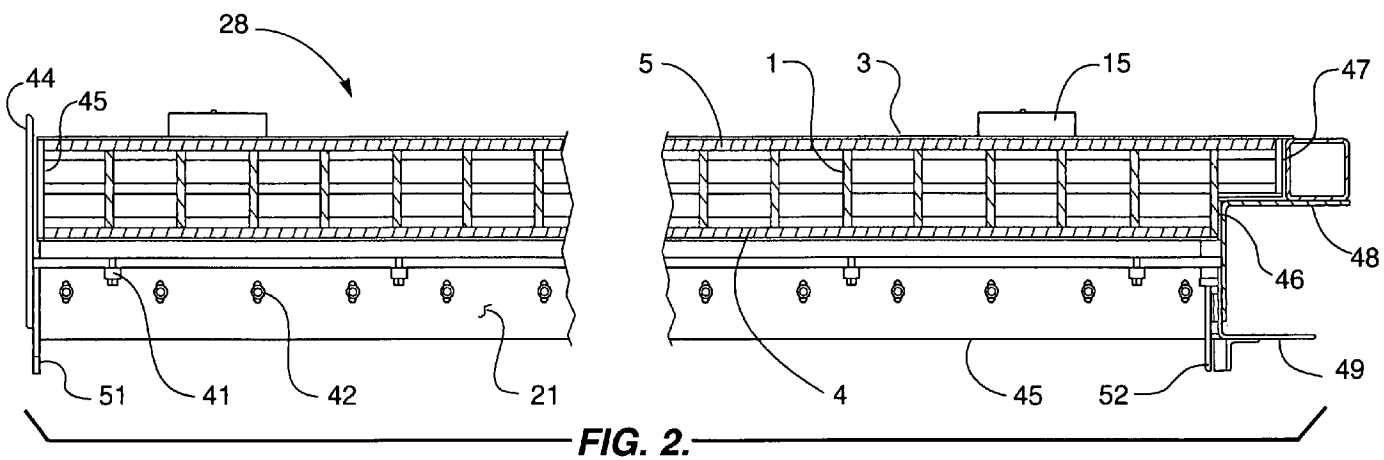
FIG. 2 is a vertical sectional view through the door.

The door panel and frame shown in FIG. 1 comprises a fabricated box construction indicated generally by reference numeral 28 and comprised of an outer main skin 3, a rear skin 4, a hinge side assembly plate 7, and a lock side assembly plate 6, series of main spars 1 and a series of vertical support bars 2. These components are welded together to form the structural body of the door panel.

A lightweight standoff panel 11 is rigidly attached to the outer skin panel 3. The standoff panel can cover the entire surface of the door panel or cover only critical areas such as the standoff panel shown in FIG. 1, which protects the doors locking assembly 10 and seam 25 between door panel 28 and door frame 29. A standoff panel 11 such as the one shown in FIG. 1 is considered sacrificial and is meant to keep the first explosive event from being placed directly onto the outer door skin. This greatly reduces the efficiency of the first explosive event. Standoff panels are constructed using very thin steel or composite materials. This minimizes the generation of fragments and further limits the damage done to the outer skin 3 by the explosive.

The outer skin 3 is meant to present a continuous physical barrier of sufficient hardness and strength to slow attacks utilizing all forms of cutting and hand tools and acts as a connecting member for each of the individual main spars 1. The connection to the individual spars 1 is made using connecting tabs 9 which are integral to the construction of the main spars 1. These tabs 9 pass through slots 27 cut into the optional composite layer 5 and outer skin 3. The tabs are welded to the outer skin 3 at each of the connecting slots 27 as indicated at 53.

A series of optional composite layers 5 directly behind the outer skin are designed to present a breech resistant barrier specific to an individual or set of non-explosive attach techniques such as torches, abrasive saws, drills, etc. This feature is dictated by the specific requirements of the door system to resist attack techniques other than explosives. The placement of the optional composite layer 5 helps to limit the effectiveness of the first explosive event by decoupling and reducing the shock wave transmission from the outer skin panel 3 through to the main spars 1. The composite layer may comprise material, such as plywood, fiberglass or rubber composites.

The core of the door panel is a plurality of structural spars 1 constructed in such a way as to present a physical barrier to the passage of an attacker even after a series of explosive charges have been detonated on the panel's outer surface in an attempt to produce a man sized hole. These spars are interconnected to each other by a set of vertical support bars 2 and are directly welded to the external formed metal framework comprised of a hinge side assembly plate 7, lock side assembly plate 6, top plate 47, top spar 46 and bottom spar 45. These plates along with the outer main skin 3 and rear skin 4 comprise the outer surface of the door assembly 28 and provide sufficient strength to resist the forces involved in an advanced explosive attack.

The rear skin 4 is connected to the main spars 1 in the same way, as is the outer skin 3. An expanded metal mesh panel 30 may be placed between the main spars 1 and the rear skin 4 in place of the composite layers used behind the outer main skin 3. The connecting tabs 9 of the spars 1 pass through slots 31 cut in the expanded metal mesh panel 30 and through slots 32 cut into the rear skin 4. Tabs 9 are welded to the expanded metal mesh panel 30 and also to the rear skin 4 as indicated by reference numeral 54.

The purpose of the expanded metal mesh panel 30, if used, is to provide an additional physical barrier to hinder passage of an attacker. As the expanded metal mesh panel has a relatively open surface area it will allow the gas generated during the explosive event to pass through and limit the amount of material removed. The ability of the expanded metal mesh 30 to crush and absorb energy also help in mitigating the effects of an explosive device, placed onto the surface of the rear skin 4 of the door panel 28. This is a useful feature should an attacker be able to form a hole in the door panel large enough to pass an explosive device through to generate an outward force on the door assembly.

An optional energy-absorbing fill can be placed within the cavity between the outer main skin 3 and the rear skin 4. It can be a loose fill such as vermiculite or cast fill, such as glass micro balloon filled gypsum. This energy-absorbing fill can also be placed within the volume 24 of the standoff panel 11.

The doorframe assembly 29 must be capable of providing an interface between the door panel 28 and the wall opening 33 while providing the required level of protection for the interface area of the door-to-frame interface 25 and the frame-to-wall interface 34.

The door is mounted to the frame utilizing a pair of hinges 15 which are bolted to the hinge side vertical support tube 13 of doorframe 29 and the main skin 3 of door panel 28.

To secure door panel 28 into frame 29 a set of tabs interface with the frame on the hinge side. These are the forward capturing tabs 8 and the rear capturing tabs 35. These tabs are part of the main spars 1 and are designed to interlock into mating slots in both the vertical support tube 13 and the hinge side assembly plate 22.

The forward capturing tabs 8 fit into a set of slots 36 cut into the vertical support tube 13, these forward capturing tabs 8 fit behind a tab contact bar 14 which secures the forward capturing tab from being torn out of the vertical support tube 13 during an explosive event. The rear-capturing tab 35, fits into slot 37, which are cut into the hinge side assembly plate 22. Both tabs offer a simple and inexpensive way to effectively secure the hinge side of the door.

The lock side of the door panel is secured using any number of well-known locking systems. Either a mechanical locking system an example of one is shown in FIG. 1 can be used or a magnetic locking system can be used. Either locking system can easily be incorporated into the door system utilizing the locking system carrier plate 10 as the interface. The purpose of the locking system carrier plate 10 is to evenly distribute the forces transmitted during an explosive event from the door panel 28 through the lock assembly and into the doorframe 29. Each of the main spars 1 are connected to the locking system carrier plate 10 by means of a main spar carrier plate tab 39 which is welded into slot 38 in the locking system carrier plate 10.

The doorframe is constructed in two assemblies. A doorframe assembly 29 and a squeeze frame assembly 40. The system is designed to be fitted into existing wall openings and is capable of being leveled and squared to that opening. To accomplish this a series of leveling screws 43 are placed onto the face surface and the side surface of the doorframe 29 and the rear surface of the squeeze frame 40.

To mount the doorframe 29 and squeeze frame 40 the two units are placed into the rough opening of the wall and the two units fastened together using frame tension bolts 41 and clamping bolts 42 the two frame elements can then be leveled and squared using adjustment screws 43 at which point the assembly can then if desired be welded together and grouted for a permanent installation.

Spar Description:

The main spars 1 are the key elements of the door panel of this invention. They are engineered to provide support for the inner skin 4 and outer skin 3 along with connecting the side frame members 6 and 7, top plate 47, top spar 46 and bottom spar 45 of the door. This unitized construction offers great strength and rigidity. This gives the panel the structural integrity necessary to provide an extended period of resistance to an advanced breeching attack. To do so it incorporates many features all of which have specific functions necessary to defeat advanced breeching attack scenarios.

The spars 1 are made from very high strength steel capable of resisting the pressures present in close proximity to an explosive event and are oriented so that the spars closest to the explosive event present their edges to the explosion.

Spars 1 further from the explosion are subject to large thrusting forces from the high velocity gas and products of detonation striking the spars top or bottom surfaces. The effect of these forces is effectively reduced by the provision of an array of two series of holes 16 and 17 in the spars.

The series of holes 16 and 17 not only vent gasses through spars remote from the actual explosion, but play a role in controlling the stresses present along the outer edges of the spars in the immediate vicinity of the explosive charge. Actual pressures along the outer edges of these spars can exceed several million pounds per square inch. As there is no known material that can withstand such forces, it is a feature of this invention that the spars 1 are designed to have their outer edges ablated to absorb energy and preserve the integrity of the remainder of the body of each spar.

Figure 3:
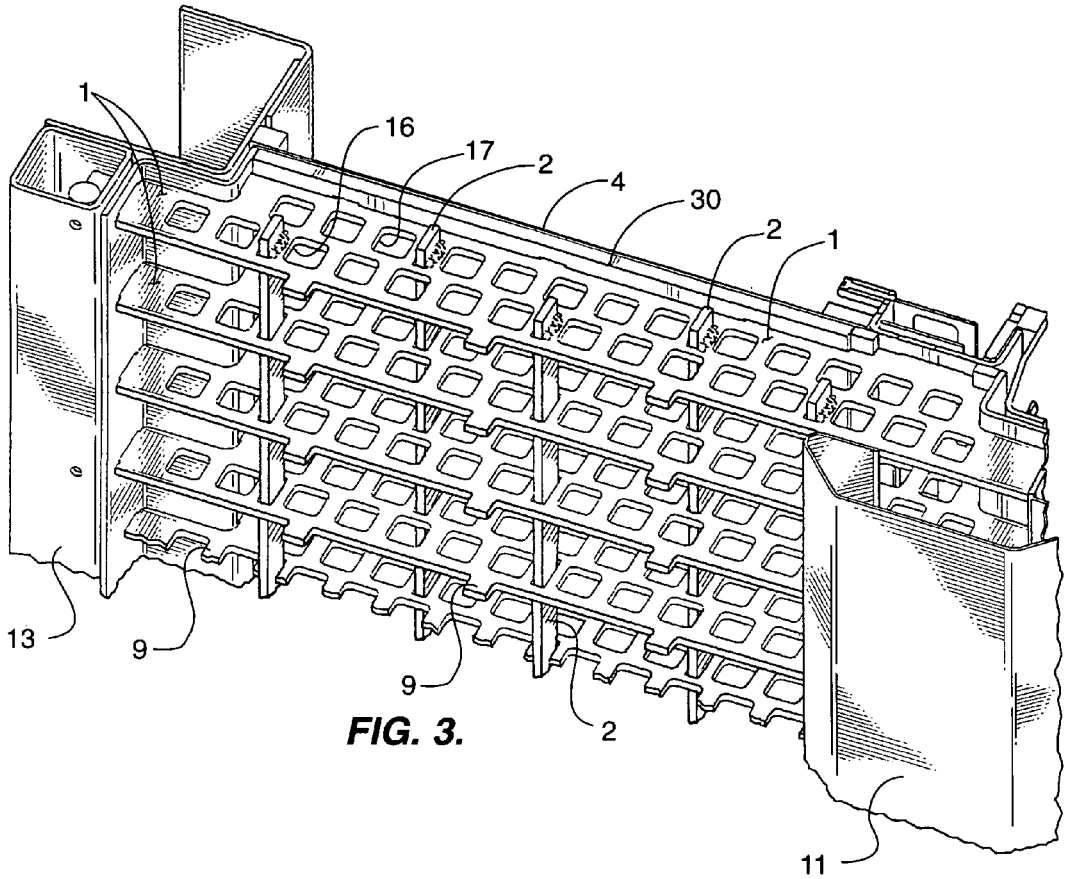
FIG. 3 is a fragmentary perspective view of a portion of the door with the outer skin removed and with a portion broken away to foreshorten the view.

These characteristics are imparted to the spars 1 by the relative positioning of the two series of holes 16 and 17. As shown in FIGS. 1 and 3 the series of holes 16 closest to the outer skin 3 are staggered with respect to the series of holes 17 closest to the rear skin 4. This arrangement provides a shear, or failure, area 18 and a yield, or collapse, area 19.

Figure 4:
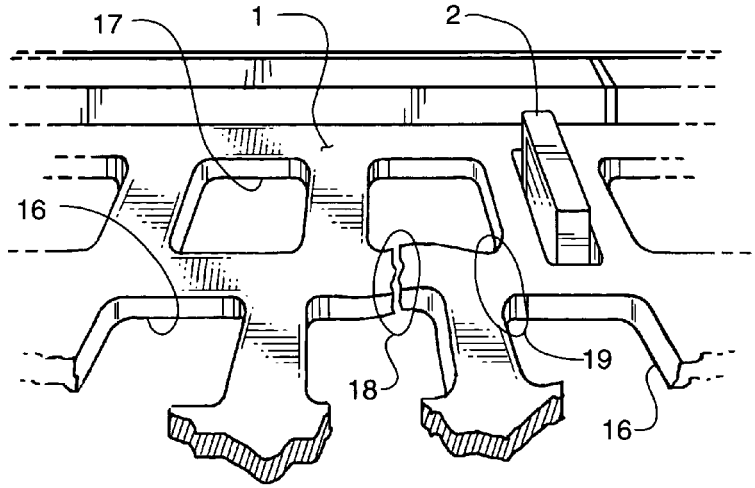
FIG. 4 is an enlarged fragmentary view of a spar portion of the door, which has been subjected to a blast event.

Spar elements along the outer edge closest to the explosive event are considered sacrificial and are generally fractured along their leading edge due to shock wave interaction or rarefaction. Rearward thrusting forces transmitted through the spar body must transmit their force through sections of the spar which first focus the force within the shear area 18 causing a local failure in the spars web then through the collapse area 19 where plastic deformation of the spars web can take place thereby absorbing energy while still remaining intact. This preserves the maximum amount of spar to resist the next explosive event. See FIG. 4 which illustrates this manner of partial failure of a spar.

If the threat for a specific application requires the door resist only one explosive event then the spar spacing need only be sufficient to stop the passage of the attacker after the single explosive event. In a single event the explosives can only be placed onto the outermost panel surface with the location of the explosives in a known position where a successful outcome can be guaranteed. Experience has shown that a main spar placement distance of 6" is adequate under the single event scenario while explosive charge weight would dictate spar thickness and depth.

If however the door is required to resist multiple explosive events then the ability of the spars to resist the explosives is far more difficult to guarantee. After the first event utilizing an explosive charge at the maximum designed explosive weight limit it is envisioned that a significant hole in the outer skin along with a significant penetration through the optional composite layers and rear skin would be present. This might allow the attacker to place a second explosive charge within the door panel body. If the open space between vertical and horizontal spars is greater then a critical distance then the attacker would be able to place an explosive charge large enough to breech the spar assembly in less then the minimum number of events. If however the spars were closer then this critical distance then the charge weight would be insufficient to clear the spars with the number of charges, which the door was designed to resist.

When developing the spacing between main spars a ratio of 1 to 1 (spar width to spar spacing) will in almost all situations be sufficient to allow the spar to resist the explosive forces present in multiple event scenarios. While damage will be done to the spar due to its close proximity to the explosive its effect will be greatly limited.

To recap—the principal features of a door panel incorporating this invention are:

1. The main spars 1 are constructed of high strength alloy plate of the type used in ballistic applications with a hardness range from approximately 400 brinnel to over 500 brinnel.
2. Plate thickness of the spars is sized to match the explosive threat it is designed to defeat. The explosive threat is described as the weight and type of explosive used and is specified in "pounds of TNT equivalent" and the number of explosive events, which the panel will need to resist at any one location.
3. Two series of vent holes 16 and 17 are cut through the spars 1 and are arranged in a specific pattern. These holes are designed to serve several purposes.
   a. Provide an unrestricted path for the products of the explosive event both gas and fragments which are traveling tangent to the plane of the spar.
   b. Provide a means of controlling the failure mechanism of the spar when an explosive event takes place, which overmatches the capabilities of the spar to resist such an event.

This failure mechanism has two separate components. The first being an engineered shear, or failure, area 18 and the second being an engineered yield, or collapse, area 19. The failure areas are provided to control the amount of material lost in a specific event and are characterized by either a purposely designed, stress riser or an area of high shear which is designed to fail below the maximum yield point of the spar section being attacked. When such a failure mechanism breaks, it greatly reduced the stresses transmitted further into the panel core. When an engineered yield area is stressed it is designed to provide a high degree of local distortion in order to lower the transmitted stresses into the core of the panel. The spar design described above incorporates both mechanisms. These work in concert to optimize the performance of the panel.

4. A direct connecting interface to the surrounding frame assembly by either the incorporation of an integral capturing tab or a mechanical locking system connected to the spar element to transfer the thrust and rebound from the explosive event to the framework elements and then directly into the supporting wall.
5. A series of cross support members 2 which pass through the spars 1 in various locations and is designed to help maintain the spars position against the high pressure gases impinging on the spar surfaces from gases and fragments traveling tangent to the plane of the spar and present another barrier which will need to be removed in order to effect a successful breech.

What is claimed is:

1. A blast resistant door panel comprising:

an outer skin, a rear skin positioned substantially parallel to and spaced from the outer skin and a plurality of spaced apart non intersecting spars each extending between said outer skin and said rear skin, said spars being characterized by having a series of holes through each of the spars along the length of the spar.

2. The door panel of claim 1 further comprising a series of support bars extending through and at substantially right angles to the planes of the spars.

3. The door panel of claim 1 further comprising a standoff panel covering at least a portion of the outer skin in spaced relation thereto.

4. The panel of claim 1 further comprising a plurality of connecting tabs along an edge of each of said spars, and a plurality of openings in said outer skin corresponding to and adapted to receive the connecting tabs on each of said spars.

5. The panel of claim 4 wherein each of said connecting tabs is welded to said outer skin.

6. The panel of claim 1 further comprising a plurality of connecting tabs along an edge of at least one of said spars, and a plurality of openings in said rear skin corresponding to and adapted to receive the connecting tabs on said one spar.

7. The panel of claim 6 wherein each of said connecting tabs is welded to said rear skin.

8. A blast resistant door panel comprising:

an outer skin, a rear skin positioned substantially parallel to and spaced from the outer skin and a plurality of spaced spars each extending between said outer skin and said rear skin, said spars being characterized by having a first series of holes therethrough closer to the outer skin of the panel and a second series of holes therethrough closer to the rear skin of the panel.

9. The door panel of claim 8 further characterized in that the first series of holes in the spars are staggered with respect to the second series of holes.

10. The door panel of claim 8 further comprising a series of support bars extending through and at substantially right angles to the planes of the spars.

11. The door panel of claim 9 further comprising a series of support bars extending through and at substantially right angles to the planes of the spars.

12. The combination of:

a blast resistant door panel having an outer skin, a rear skin positioned substantially parallel to and spaced from the outer skin and a plurality of spaced spars each extending between said outer skin and said rear skin, a door frame assembly having a slot therein and a hinge connecting the panel to the door frame assembly, at least one of said spars having a locking tab extending from an end thereof into the slot in the doorframe assembly when the panel is in its closed position, said spars being characterized by having a series of holes through each of the spars along the length of the spar.

13. The combination of claim 12 wherein said doorframe assembly has a plurality of slots therein and each of said spars has a locking tab extending from an end thereof into a slot in the doorframe assembly when the panel is in its closed position.

14. A blast resistant door panel comprising:

an outer skin, a rear skin positioned substantially parallel to and spaced from the outer skin and a plurality of spaced spars each extending between said outer skin and said rear skin, said spars being characterized by having a series of holes through each of the spars along the length of the spar, a plurality of connective tabs along an edge of at least one of said spars, and a plurality of openings in said outer skin corresponding to and adapted to receive the connecting tabs on said one spar.

15. The panel of claim 14 wherein each of said connecting tabs is welded to said outer skin.

16. A blast resistant door panel comprising:

an outer skin, a rear skin positioned substantially parallel to and spaced from the outer skin and a plurality of spaced spars each extending between said outer skin and said rear skin, said spars being characterized by having a series of holes through each of the spars along the length of the spar, a plurality of connecting tabs along an edge of each of said spars, and a plurality of openings in said rear skin corresponding to and adapted to receive the connecting tabs on each of said spars.

17. The panel of claim 16 wherein each of said connecting tabs is welded to said rear skin.

18. A blast resistant door panel comprising:

an outer skin, a rear skin positioned substantially parallel to and spaced from the outer skin and a plurality of spaced spars each extending between said outer skin and said rear skin, said spars being characterized by having a series of holes through each of the spars along the length of the spar, a plurality of connecting tabs along opposite edges of at least one of said spars, and a plurality of openings in said outer skin and said rear skin corresponding to and adapted to receive the connecting tabs on said at least one spar.

19. The panel of claim 18 wherein each of said connecting tabs along one edge of said at least one spar is welded to said outer skin and each of said connecting tabs along the opposite edge of said at least one spar are welded to said rear skin.

20. A blast resistant door panel comprising:

an outer skin, a rear skin positioned substantially parallel to and spaced from the outer skin and a plurality of spaced spars each extending between said outer skin and said rear skin, said spars being characterized by having a series of holes through each of the spars along the length of the spar, a plurality of connecting tabs along opposite edges of each of said spars, and a plurality of openings in said outer skin and said rear skin corresponding to and adapted to receive the connecting tabs on said spars.

21. The panel of claim 20 wherein each of said connecting tabs along one edge of each of said spars is welded to said outer skin, and each of said connecting tabs along the opposite edge of said spars is welded to said rear skin.

* * * * *